United States Patent [19]

Dahl

[11] 4,037,282

[45] July 26, 1977

[54] PROCESS FOR CREATING OVERLOAD PROTECTION AGAINST YIELDING IN BOLTS

[76] Inventor: Norman C. Dahl, 40 Fern St., Lexington, Mass. 02173

[21] Appl. No.: 693,546

[22] Filed: June 7, 1976

Related U.S. Application Data

[63] Continuation-in-part of Ser. No. 664,574, March 8, 1976.

[51] Int. Cl.[2] ..... F16B 31/02

[52] U.S. Cl. ..... 10/27 R; 29/526

[58] Field of Search ..... 10/27 R, 27 H; 29/446, 29/452, 526; 85/1 T, 62; 148/12 B; 81/52.4 R; 73/99

[56] References Cited

U.S. PATENT DOCUMENTS

| | | | |
|---|---|---|---|
| 3,602,976 | 9/1971 | Grube | 29/526 |
| 3,757,630 | 9/1973 | Dahl | 10/27 R X |

*Primary Examiner*—Milton S. Mehr

*Attorney, Agent, or Firm*—Richard P. Crowley

[57] ABSTRACT

A method for creating built-in overload protection against further yielding in a threaded bolt which previously has been tightened to its yield point, said method comprising: reducing the torque acting in the shank of said bolt to fifty percent or less of the value existing at the end of tightening, said reduction in torque being accomplished by rotating the bolt head or the nut in the direction opposite from tightening through an angle $\theta$ such that the reduction in twist of said shank causes said torque to reduce to fifty percent or less of the value existing at the end of tightening and where said angle of rotation $\theta$ is not large enough to cause decrease in the tension existing in said bolt at the end of tightening.

7 Claims, 19 Drawing Figures

PROCESS FOR CREATING OVERLOAD PROTECTION AGAINST YIELDING IN BOLTS

REFERENCE TO PRIOR APPLICATIONS

This application is a continuation-in-part of my U.S. application Ser. No. 664,574, filed Mar. 8, 1976.

BACKGROUND OF THE INVENTION

With increasing demands for higher performance of machinery and the conservation of material and energy used to make machinery there are demands for higher performances of the various components of the machinery. In respect to bolts these demands result in pressures to tighten bolts to a higher percentage of their tensile strength so that fewer or smaller bolts will accomplish the required job. In response to these pressures more and more bolt users are tightening bolts until yielding occurs, on the theory that this produces the maximum feasible level of tension which it is safe to put in the bolt.

As part of this movement towards higher bolt tensions, recently there have been announcements of two wrenching systems which have the capability to tighten bolts until yielding has just occured, (*Machine Design,* Vol. 47, No. 2, Jan. 23, 1975, page 44, and *Design News,* Vol. 30, No. 17, Sept. 8, 1975, page 57, both herein incorporated by reference). These systems incorporate means for measuring the wrenching torque and rotation of the nut (or bolt, if the bolt head is being wrenched) and they determine when yielding occurs, and hence the wrenching should be stopped, by monitoring when the slope of the torque-rotation curve drops appreciably, this drop in slope being characteristic of the bolt as it passes through the yield point from the region of elastic behavior to that of plastic behavior. In my copending application, "Process for the Pre-use Work-Hardening of Bolts and Bolts Obtained Thereby, " Ser. No. 664,574, herein incorporated by reference, I describe a simple and inexpensive method of treating bolts in such a way that all bolts so treated will have the same yield point (proof load) and thus all will have the same tension (preload) when tightened to their yield point.

While the combination of these new wrenching systems and the method of pre-use treatment put forward in my copending application leads to high and uniform in-place bolt tensions, there is one problem with tightening bolts until they reach their yield point. A bolt tightened to this condition will yield further if, under service conditions, external forces put any additional increment of load on the bolt. The bolt extension accompanying this yielding may cause the bolted joint to malfunction immediately, such as, for example, to cause loss of pressure in a pipe flange connection. Further, when subsequently, the external forces change again so as to remove the increment of load the bolt will be longer by the amount of the further yielding and its clamping tension will be reduced proportional to the amount of this additional elongation. In short, the problem with tightening a bolt to its yield point is that the bolt then has no built-in overload protection against further yielding or against loss of preload.

SUMMARY OF THE INVENTION

I have invented a practical and economical method for creating a margin of built-in overload protection in a bolt which has been tightened to its yield point.

As a bolt it tightened to its yield point it yields under the combined influence of the tension and torque acting on the bolt. When the tightening is stopped this tension and torque remain acting on the bolt. My invention consists of providing additional wrenching means for rotating the nut (or bolt head), in the direction opposite from tightening, through an angle sufficient to reduce this bolt torque to one-half or less of its value without creating any reduction in the tension preload.

The practical consequence of reducing the bolt torque to this level is that if, under service conditions, the bolt is subjected to an additional increment of load the bolt will not yield further so long as the increment of load does not exceed about 10 percent of the bolt tension created by the original tightening. Thus, use of my invention on a bolt which has been tightened to its yield point creates in the bolt about 10 percent built-in protection against further yielding or against loss of preload.

DESCRIPTION OF THE PREFERRED EMBODIMENT

Figure 1:
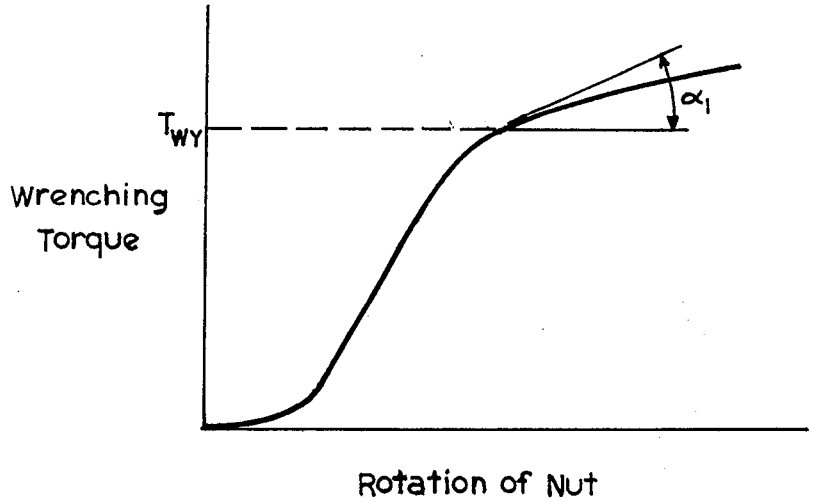
FIG. 1 depicts the relation between wrenching torque and nut rotation as a bolt is tightened until it yields.

As a bolt is tightened there is initially a slow increase of wrenching torque with nut rotation as the various components of the joint come into firm bearing contact. Thereafter, the wrenching torque increases rapidly with nut rotation in a substantially linear relation until yielding of the bolt begins, after which the wrenching torque begins to increase much less rapidly with nut rotation and to depart more and more from this linear elastic relation. This general behavior is depicted in FIG. 1. The onset of yielding in normal bolts is not a sharp change in behavior and hence the yield point usually is defined as being reached when the slope angle of the torque-rotation curve reaches some specified value. The new wrenching systems cited earlier (op.cit. *Machine Design* and *Design News*) operate so as to stop tightening when the torque-rotation slope angle reaches some preset value $\alpha_1$ such as illustrated in FIG. 1.

Figure 2A:
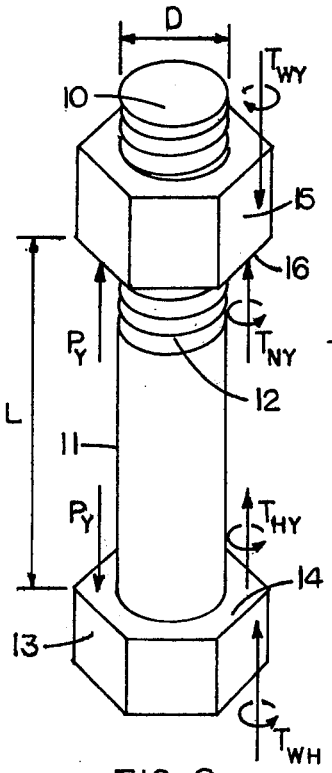
FIG. 2*a* shows the external and FIGS. 2*b* and 2*c* the internal forces and torques acting on a bolt-nut combination as the bolt reaches its yield point under the influence of a wrenching torque.
Figure 2B:
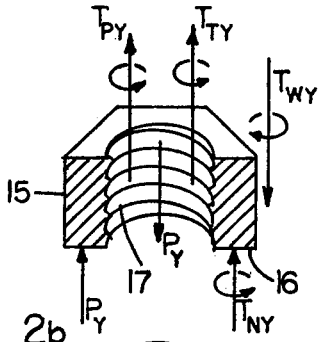
Figure 2C:
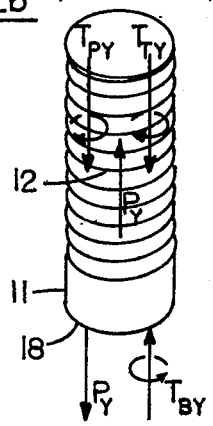

FIG. 2*a* shows the external forces and torques acting on a bolt 10 and nut 15 when the bolt just yields as it is tightened by rotation of the nut 15 under the influence of a wrenching torque $T_{WY}$ while the bolt head 13 is held stationary by the action of a frictional torque $T_{HY}$ acting on the bearing surface 14 of the bolt head and, if necessary, an external torque $T_{WH}$. Tension is generated in the bolt by forces $P_Y$ which act on the bearing surface 16 of the nut and the bearing surface 14 of the bolt head. A frictional torque $T_{NY}$ will be generated on the bearing surface 16 of the nut as the surface 16 slips rotationally relative to its abutting surface FIG. 2*b* and 2*c* show the internal forces and torques acting in the bolt-nut combination of FIG. 2*a*. In FIG. 2*b* it may be seen that the tension $P_Y$ is acting on the nut threads 17, and the torque $T_{PY}$ results from the fact that the threads 17 are inclined to the bolt axis by their helix angle. The torque $T_{TY}$ is a frictional torque generated on the threads 17 by the rotational slip of the threads 17 relative to the bolt threads 12. FIG. 2*c* shows the force and torques acting on the bolt threads 12 and, also, the tension $P_Y$ and torque $T_{BY}$ acting on the cross section 18 of the bolt shank 11. Many measurements under varying conditions of friction have established that the wrenching torque $T_{WY}$ is proportionally related to the bolt tension $P_Y$ as follows (see *Machine Design,* Vol. 47, No. 5, Mar. 6, 1975, page 79)

$$T_{WY} = KDP_Y \tag{A}$$

when $D$ is nominal bolt diameter and $K$ is an experimentally demined torque coefficient which for normal dry surfaces and normal unlubricated bolts has the value of about 0.2. It also has been established that the torques $T_{PY}$, $T_{TY}$ and $T_{NY}$ have approximately the following values $$T_{PY} = 0.1\ T_{WY}$$

$$T_{TY} = 0.4\ T_{WY}$$

$$T_{NY} = 0.5\ T_{WY} \tag{B}$$

With these values it may be calculated from FIG. 2*c* that $$T_{BY} = T_{PY} + T_{TY} = 0.5\ T_{WY} \tag{C}$$

Figure 3:
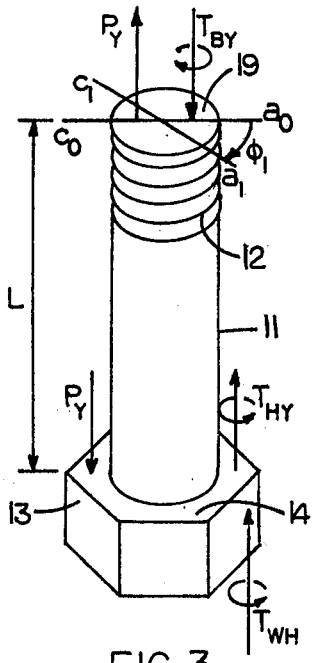
FIG. 3 illustrates the twist of the bolt of FIG. 2*a* and the torque causing this twist.

FIG. 3 shows the twist of the shank 11 caused by the torque $T_{BY}$. $\phi_1$ is the angle through which the cross sectional surface 19 rotates relative to the other end of the shank located at the bolt head bearing surface 14. If the end of the shank located at the bearing surface 14 is held so that it does not rotate then the surface 19 will rotate through an angle $\phi_1$ in the direction shown in FIG. 3. The magnitude of $\phi_1$ can be calculated for a given $T_{BY}$.

Figure 4A:
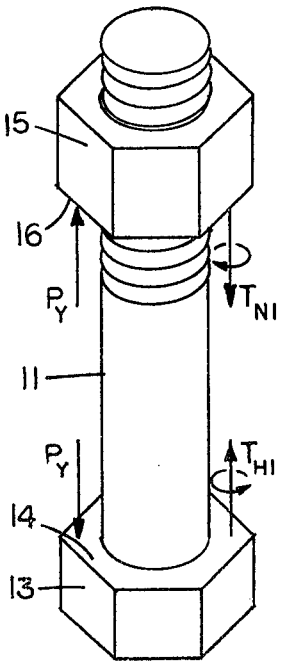
FIG. 4*a* shows the external and FIGS. 4*b* and 4*c* the internal forces and torques acting on the bolt-nut combination of FIGS. 2*a,* 2*b* and 2*c,* respectively, after the wrenching torque has been removed.
Figure 5:
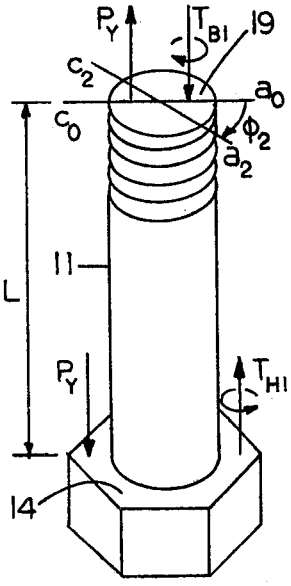
FIG. 5 illustrates the twist and torque conditions in the bolt of FIG. 4*a.*

When the tightening wrench and the wrench on the bolt head (if such a wrench is needed during tightening) are removed the external forces and torques acting on the bolt-nut combination will be as shown in FIG. 4*a*. Because the elongation of the bolt does not change when the wrench is removed the tension remains at the level $P_Y$. It is significant to note that the frictional torque $T_{N1}$ acting on the bearing surface 16 of the nut acts in the reverse direction from that of the frictional torque $T_{NY}$ which acted on this surface during tightening. The reason for this reversal may be seen by considering the twist of the shank in FIG. 5 and the internal torques which must exist as of result of this twist. The angle of twist of the surface 19 after the wrench is removed is designated by $\phi_2$ in FIG. 5. It is an observed fact that nuts do not rotate when the wrench is removed and therefore $\phi_2 = \phi_1$; i.e., the twist of the shank 11 does not decrease when the wrench is removed. Since the shank in FIG. 5 has the same twist as the shank in FIG. 3 it must be concluded that both are acted on by the same torque, or that $$T_{B1} = T_{BY} = 0.5\ T_{WY} \tag{D}$$

Figure 4B:
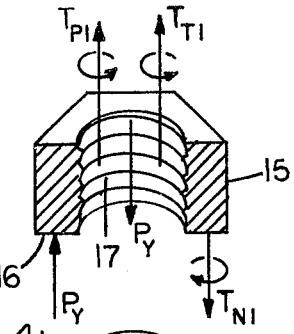
Figure 4C:
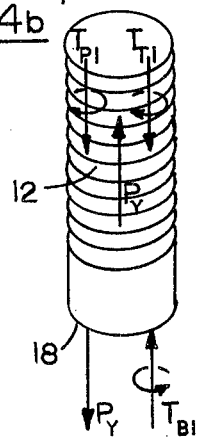

Since there is no change in the tension when the wrench is removed it follows that $$T_{P1} = T_{PY} = 0.1\ T_{WY} \tag{E1}$$

and with the results from the equations (D) and (E1) it may be seen from FIG. 4*c* that the frictional torque on the threads also does not change when the wrench is removed, namely $$T_{T1} = T_{B1} - T_{P1} = 0.4\ T_{WY} = T_{TY} \tag{E2}$$

Finally, using these values for $T_{P1}$ and $T_{T1}$ may be seen from FIG. 4*b* that $T_{N1}$ must be in the direction shown and of magnitude $$T_{N1} = T_{P1} + T_{T1} = 0.5\ T_{WY} \tag{F}$$

Thus, when the wrench is removed there is no change in the internal torques but the frictional torque on the bearing surface 16 of the nut reverses direction to resist the tendency of the nut to rotate under the influence of the internal torques.

Figure 6A:
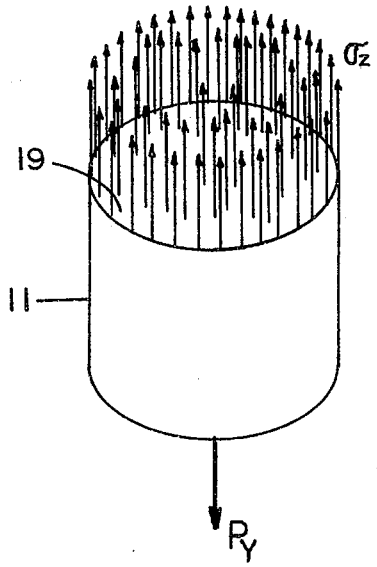
FIG. 6*a* depicts the tensile stress and FIG. 6*b* the shear stress assumed to be acting on the bolt of FIG. 2*a* when it yields under the influence of the tension $P_Y$ and the torque $T_{BY}$.
Figure 6B:
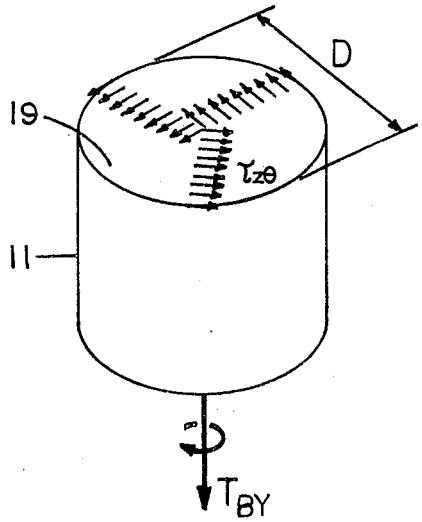

Having established that the internal tension and torque acting on cross sections of the bolt shank do not change when the wrench is removed, the next step is to calculate the magnitude of the tension $P_Y$ in relation to the force $P_1$ which causes the bolt to yield when it is loaded only in tension. When it is being tightened the bolt yields as a consequence of the combined effects of the stresses $\sigma_z$ and $\tau_{z\theta}$ created by the tension $P_Y$ and torque $T_{BY}$ as illustrated in FIGS. 6*a* and 6*b*. When only the stresses $\sigma_z$ and $\tau_{z\theta}$ are acting the metal will deform plastically at any point (see *Mechanical Behavior of Materials,* F. A. McClintock and A. S. Argon, Addison-Wesley Publishing Company, Reading, Mass., 1966, page 277) when the stresses at that point satisfy the Mises yield criterion $$\sigma_z^2 + 3\ \tau_{z\theta}^2 = \sigma^2 \tag{G}$$

where $\sigma$ is the yield stress in simple tension. Since the bolt yields at a force $P_1$ when loaded only in tension the value of $\sigma$ is (H)

-continued $$\bar{\sigma} = \frac{4P_1}{\pi D^2}$$

In order to use equation (G) it is necessary to make some assumptions about the distribution of the stresses over the cross section 19 of the bolt shank 11, and the assumption will be made that both the tensile stress and the shear stress are uniform across the shaft, as illustrated in FIGS. 6*a* and 6*b*. With this assumption the tensile stress becomes $$\sigma_z = \frac{4P_Y}{\pi D^2} \tag{I}$$

and the shear stress (see *An Introduction to the Mechanics of Solids,* S. H. Crandall and N. C. Dahl, McGraw-Hill Book Company, New York, 1959, pages 256–7) will have the value $$\tau_{z\theta} = \frac{12T_{BY}}{\pi D^3} \tag{J}$$

Substituting equations (H), (I) and (J) in equation (G) and simplifying, the following result is obtained for the tension in the bolt when yielding occurs during yielding $$P_Y = \frac{P_1}{\sqrt{1 + 27\left(\frac{T_{BY}}{DP_Y}\right)^2}} \tag{K}$$

Substituting the value of $T_{BY}$ from equation (C) and making use of equation (A) the value of $P_Y$ becomes $$P_Y = \frac{P_1}{\sqrt{1 + \frac{27}{4}K^2}} \tag{L}$$

Taking the average value of 0.2 for the torque coefficient $K$, the bolt tension at yielding will be $$P_Y = 0.89\,P_1 \tag{M}$$

or, in other words, the presence of the torque $T_{BY}$ causes the bolt to yield at 89 percent of the tension it can sustain when loaded by tension along.

Let it now be assumed that, by some means the torque in the bolt can be reduced from $T_{BY}$ to some level $T_{B2}$ and ask to what level $P_0$ the tension can be increased in the presence of this torque $T_{B2}$ before yielding once again occurs. Proceeding as was done before in developing equation (K) for tension $P_Y$, the equation for $P_0$ becomes $$P_0 = \frac{P_1}{\sqrt{1 + 27\left(\frac{T_{B2}}{DP_0}\right)^2}} \tag{N}$$

By manipulation this equation for $P_0$ can be expressed in the form $$P_0 = \frac{P_1}{\sqrt{1 + 27\left(\frac{T_{BY}}{DP_Y}\right)^2\left(\frac{P_Y}{P_0}\right)^2\left(\frac{T_{B2}}{T_{BY}}\right)^2}} \tag{O}$$

By making use of equations (C) and (A) as before, equation (O) can be written as $$P_0 = \frac{P_1}{\sqrt{1 + \frac{27}{4}K^2\left(\frac{P_Y}{P_0}\right)^2\left(\frac{T_{B2}}{T_{BY}}\right)^2}} \tag{P}$$

Finally, using the value of $P_1$ calculated from equation (L), equation (P) can be manipulated to give the ratio of $P_O$ to $P_Y$ as a function of the ratio of $T_{B2}$ to $T_{BY}$ $$\frac{P_0}{P_Y} = \sqrt{1 + \frac{27}{4}K^2\left[1 - \left(\frac{T_{B2}}{T_{BY}}\right)^2\right]} \tag{Q}$$

Figure 7:
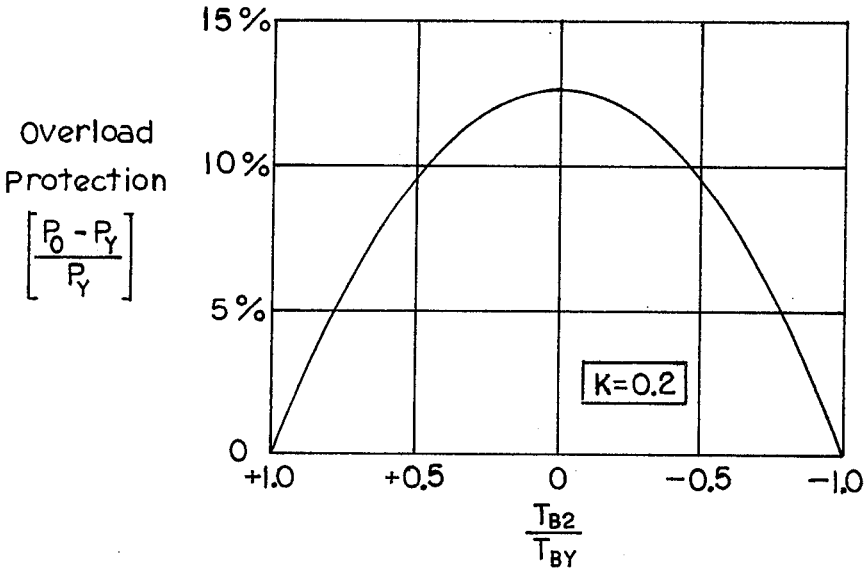
FIG. 7 shows the amount of overload protection created when the built-in bolt torque is reduced by differing amounts below its initial value of $T_{BY}$.

Using equation (Q) the percentage of overload protection created by reducing the built-in bolt torque has been calculated for difference values of $T_{32}/T_{BY}$ (for the average value of $K = 0.2$) and plotted in FIG. 7. This plot shows that 10 percent or more of overload protection can be created if the torque acting in the bolt can be reduced to about half or less of the value existing at the end of tightening. FIG. 7 shows that this overload protection also is created when the torque in the bolt is reversed, so long as its absolute magnitude is less than about half $T_{BY}$.

Figure 9:
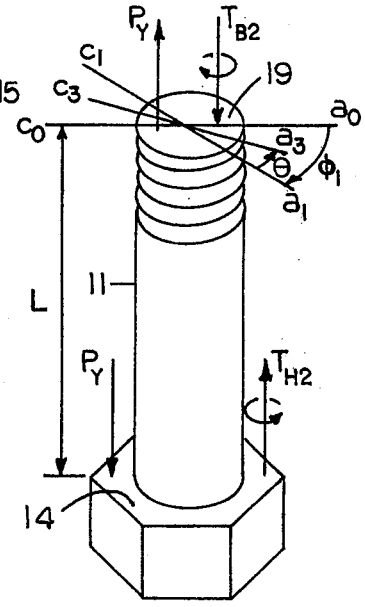
FIG. 9 illustrates the twist and torque conditions in the bolt of FIG. 8*a.*

The bolt torque can be reduced below $T_{BY}$ without reducing the bolt tension if the nut can be rotated sufficiently to reduce the twist in the bolt shank but not enough to cause the nut threads to rotate relative to the bolt threads, an action which would cause decrease in the elongation of the bolt shank and, hence, in the bolt tension. What is required is to rotate the nut, in the direction opposite from tightening, through some angle $\theta$, as shown in FIG. 9, just sufficient to bring the torque down to the desired level $T_{B2}$. $\theta$ typically will be a small angle. For example, for a $\frac{3}{4}$ inch grade 5 bolt, 4 inches long, tightened until it just yields, the angle $\theta$ required to reduce the bolt torque to zero (i.e., to make $T_{B2} = 0$) will be approximately 1.5 degrees.

The nuts may be turned through the desired angle $\theta$ by a variety of means, such as a torque wrench or an impact wrench, particularly with an impact wrench wherein the number of impacts may be selected or controlled. It may be difficult to turn nuts through such small desired angles $\theta$ with the required degree of accuracy when using a prevailing torque type of power wrench. The difficulty stems from the physical fact that the static coefficient of friction is typically some 50 percent greater than the sliding coefficient. Because of this fact there will be a sudden drop in resisting frictional torque on the nut bearing face 16 as soon as the nut begins to rotate, with the result that the prevailing torque type of wrench will tend to over-rotate the nut and thereby cause the nut to rotate relative to the bolt, with resultant decrease in bolt tension. The most practical way to achieve accuracy in turning the nut through such a small angle will be to use an impact type of wrench which is controlled to give the nut just the number and strength of rotational impacts required to rotate the nut through the desired angle $\theta$. The physical process through which an impact wrench rotates the nut so as to reduce the torque in the bolt shank by the desired amount has been investigated and it has been discovered that the number of impacts required to produce the desired angle of rotation $\theta$ varies with the angle $\theta$ in such a way as to make it very practical to provide the desired reduction in torque with an impact wrench. This physical process is now described.

Figure 8A:
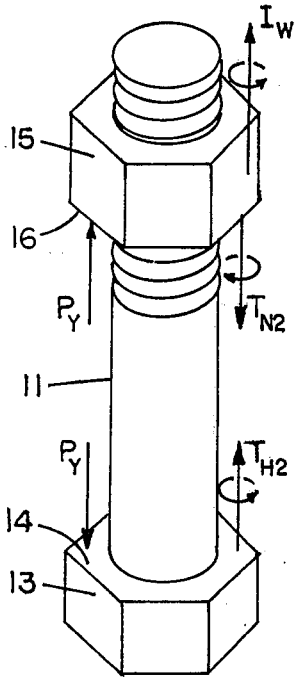
FIG. 8*a* shows the external and FIGS. 8*b* and 8*c* the internal forces and torques acting on the bolt-nut combination of FIGS. 4*a,* 4*b* and 4*c,* respectively, after it has been subjected to a number N of rotational impacts, in a direction opposite from tightening.
Figure 8B:
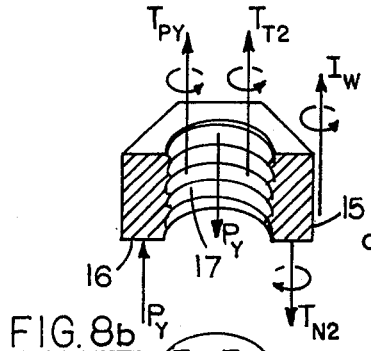
Figure 8C:
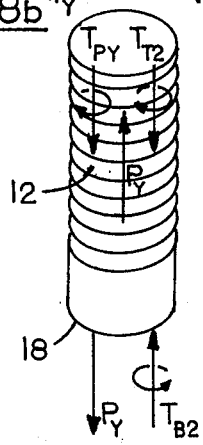

FIG. 8*a* shows a tightened bolt-nut combination in which the nut is being rotated by the influence of an impact $I_W$ delivered by an impact wrench after the nut has been rotated through an angle $\theta$ by N previous impacts. FIGS. 8*b* and 8*c* show the internal forces and torques acting in the bolt-nut combination and FIG. 9 shows the deformation of the bolt shank.

The behavior of the bolt shank will be elastic as it untwists and rotates through the angle $\theta$ and hence the reduction in bolt torque is given by the elastic relation $$T_{BY} - T_{B2} = \frac{GI_z\theta}{L} \tag{R}$$

where $$I_z = \frac{\pi D^4}{32}$$

G = Shear modulus
= $11.5 \times 10^6$ psi for steel
and $\theta$ is in radians.
Alternatively, $T_{B2}$ can be expressed as $$T_{B2} = T_{BY}\left[1 - \frac{\theta}{\theta_0}\right] = 0.5\, T_{WY}\left[1 - \frac{\theta}{\theta_0}\right] \tag{S}$$

where $$\theta_0 = \frac{T_{BY}L}{GI_z} = 0.5\,\frac{T_{WY}L}{GI_z} \tag{T}$$

Because the bolt tension remains at $P_Y$ the helix-induced torque on the threads remains at the level given by equation (B)

$$T_{PY} = 0.1\, T_{WY}$$

From FIG. 8*c* the value of $T_{T2}$ is found to be $$T_{T2} = T_{B2} - T_{PY} = 0.4\, T_{WY} - 0.5\, T_{WY}\theta/\theta_0 \tag{U}$$

Since the nut is sliding rotationally on its bearing surface 16 and the bearing force remains at $P_Y$, the value of $T_{N2}$ is the same magnitude as $T_{N1}$ at the end of tightening, namely $$T_{N2} = 0.5\, T_{WY} \tag{V}$$

Because the rotation of the nut will be small, inertia effects will play little role and the energy imparted by an impact can be assumed to be absorbed entirely by the torques acting on the nut, as shown in FIG. 8*b*. Thus, if each impact imparts an energy $e$ to the nut, the number of impacts $dN$ required to rotate the nut through an angle $d\theta$ is given by the relation $$e\, dN = (T_{N2} - T_{PY} - T_{T2})\, d\theta = 0.5\,(T_{WY}/\theta_0)\,\theta\, d\theta \tag{W}$$

Integrating equation (W), the number of impacts required to rotate the nut through an angle $\theta$ is found to be $$N = \frac{T_{WY}}{4\theta_0 e}\,\theta^2 \tag{X}$$

By use of equation (T) in equation (X) the value for $N$ can be expressed as $$N = \frac{4LT_{WY}^2}{\pi GD^4 e}\left(\frac{\theta}{\theta_0}\right)^2 \tag{Y}$$

Actually, equation (Y) is valid only so long as the nut does not rotate with respect to the bolt. Rotation of the nut relative to the bolt will occur whenever there is a demand for the absolute value of $T_{T2}$ to be larger than 0.4 $T_{WY}$, which is the maximum value which friction will allow it to be. From equation (U) it may be seen that $T_{T2}$ reaches the value $-0.4\, T_{WY}$ at $\theta = 1.6\, \theta_0$. For values of $\theta$ greater than this the impacts will tend to cause the nut to rotate relative to the bolt and, thereby, to reduce the tension below the value $P_Y$. Thus, $\theta = 1.6\, \theta_0$ is the maximum angle through which the nut should be rotated.

Figure 10:
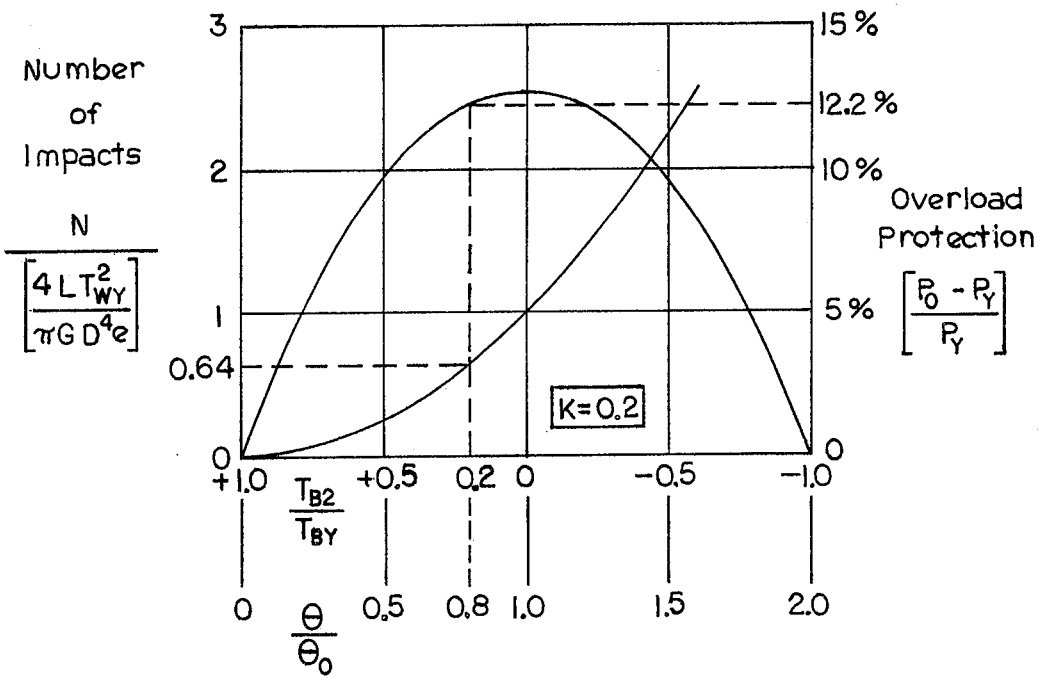
FIG. 10 shows the relation between the number of impacts, the amount of untwisting of the bolt and the amount of overload protection created by the untwisting.

Equation (Y) is plotted in FIG. 10 for the range $\theta = 0$ to $\theta = 1.6\, \theta_0$, along with the overload protection curve from FIG. 7. As an example of use of FIG. 10, a rotation of $\theta = 0.8\, \theta_9$ will result in reduction of the bolt torque to $T_{B2} = 0.2\, T_{BY}$ which will create an overload protection of 12.2 percent, and it will require $$0.64\left[\frac{4LT_{WY}^2}{\pi GD^4 e}\right]$$

impacts to produce the rotation $0.8\, \theta_0$. The most sensible design criterion appears to be to aim at producing that $\theta$ which will give the maximum amount of overload protection, namely $\theta = \theta_0$. With this value of $\theta$ the required number of impacts will be $$N_{Design} = \frac{4LT_{WY}^2}{\pi GD^4 e} \tag{Z}$$

Even if the rotation actually produced differs from the design rotation $\theta = \theta_0$ by a factor of 50 percent, either too small or too large, the overload protection created still will be at least 10 percent, as may be seen by noting in FIG. 10 that in the range $0.5\, \theta_0$ to $1.5\, \theta_0$ the overload protection is 10 percent or more. To make errors this large in producing the design rotation would mean that large errors would have to be made in estimating the number of impacts required to produce $\theta = \theta_0$: it would be necessary to underestimate $N_{Design}$ by a factor of 4 to produce $\theta = 0.5\ \theta_0$ and to overestimate $N_{Design\ by\ a\ factor\ of}$ 2.25 to produce $\theta = 1.5\ \theta_0$. With adequate experimental investigation which establishes for various situations the effective value of $e$, the energy transmitted by each impact, such large errors in estimation of $N_{Design}$ are not going to occur. Thus, it is evident that the physical process through which an impact wrench rotates a nut so as to reduce the torque in the bolt shank provides a practical way to carry out my method for creating built-in overload protection against yielding in bolts which have been tightened to their yield point.

To illustrate how my method for creating overload protection can be incorporated in a wrench I will now describe detailed functions which should be embodied in wrenches to carry out my method. Assuming that impact wrenching is the most accurate way to rotate the nut through the desired angle of rotation $\theta$, the wrench should be capable of delivering a specified number of impacts which depends upon the length, diameter and shear modulus of the bolt, upon the wrenching torque at yielding and upon the energy transmitted by each impact, as illustrated by equation (Z). Thus, a basic requirement is that such a wrench should incorporate means for counting the number of untwisting impacts and stopping the wrench when the number of impacts reaches a preset level $N_{Design}$. In terms of actual elements, the wrench should incorporate in combination a computer element, a means by which the user can set the number $N_{Design}$ in the computer memory, a sensor element which senses each impact and then sends an electric impulse to the computer and programming of the computer to stop the wrench when the total number of these electric impulses equals the number $N_{Design}$.

The simplest version of a wrench would be one in which the number $N_{Design}$ is calculated outside the wrench and is stored in the computer by input means provided on the wrench. The value of $T_{WY}$ used in the calculation would be obtained from equation (A) with appropriate values of $K$ and $P$ for the particular bolt and friction conditions. This wrench would be the most economical, and therefore the preferred, version for production line use where the wrench will be used on the same bolt for extended periods of time. Where such a wrench will be used for bolts of different size or grade, means would be provided for adjusting the energy $e$ imparted by each rotary impact.

Such wrenches could be provided as individual wrenches to be used in sequence after removal of a wrench used to tighten the bolt to yielding. However, this is likely to be uneconomic because of the extra labor involved in changing wrenches and, hence, the preferred version of a wrench will be one which incorporates the untwisting wrenching together with wrenching means for tightening the bolt to yielding, with automatic initiation of the untwisting wrenching upon completion of the tightening.

The untwisting wrenching means can be incorporated with a tightening wrenching means of either the impact type or the prevailing torque type. When the tightening wrenching means is of the impact type the impacting for untwisting can be accomplished by reversal of the normal tightening impacting process, a reversing facility which is incorpoated in many impact wrenches now on the market. The desired level of the energy $e$ to be imparted by each impact during untwisting will be less than the desired level of the energy delivered by each impact during tightening, and thus means will have to be provided for automatically changing the impact energy level when the wrench switches to untwisting impacts.

Figure 11:
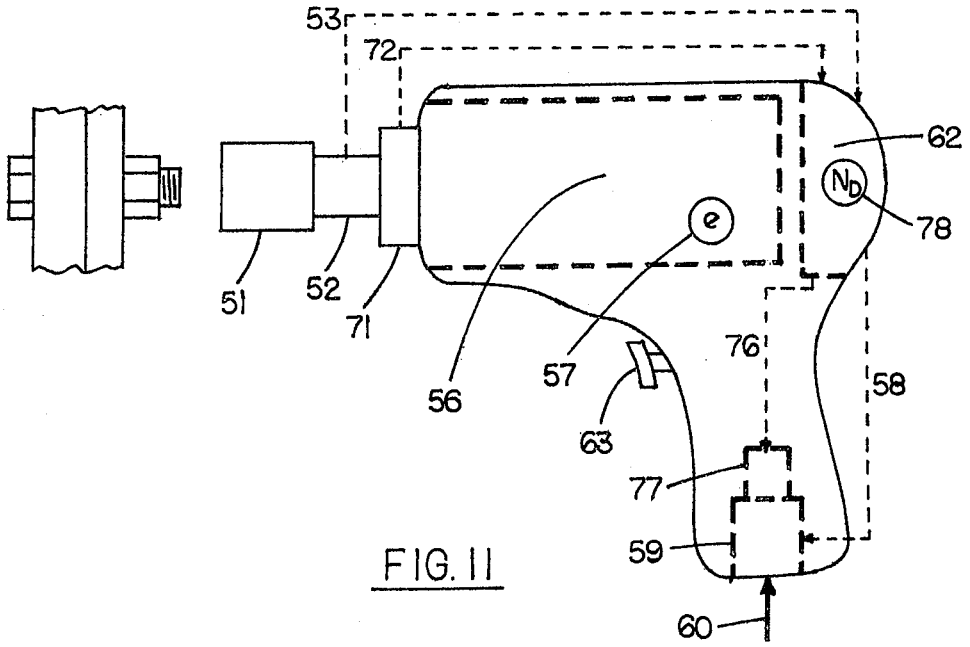
FIG. 11 is a schematic diagram of an impact type of wrench for tightening bolts which also incorporates impact means for untwisting the bolts according to the teaching of my invention.

FIG. 11 shows a schematic diagram of a wrench which incorporates impact means for tightening a nut (or bolt) and impact means for untwisting the bolt according to the teaching of my invention. The wrench impact mechanism 56 can be of any of the several designs currently on the market with capability of reverse impacting and it will be provided with means 57 for setting the impact energy level $e$ of the reverse impacts. The driving socket 51 is powered by a torque control element 52 which sends a signal 53 to the computing element 62 when the bolt has been tightened to its yield wrenching torque $T_{WY}$. Input means 78 is provided for storing $N_{Design}$ in the computing element memory. When the computing element 62 receives the signal 53 that the bolt has been tightened to torque $T_{WY}$ it sends signal 76 to reversing means 77 to initiate reverse impacts. For each reverse impact the reverse impact sensor 71 sends a signal 72 to the computing element 62 where they are accumulated in a register. When the number in the register reaches the value $N_{Design}$ stored in the computer memory the computer sends a signal 58 to the value (or switch) 59 to shut off the power 60 to the wrench. Thus, to operate the wrench the operator merely squeezes the trigger 63 and holds it until the wrench stops automatically, at which point the bolt will have a built-in overload protection of 10 percent or more.

Figure 12:
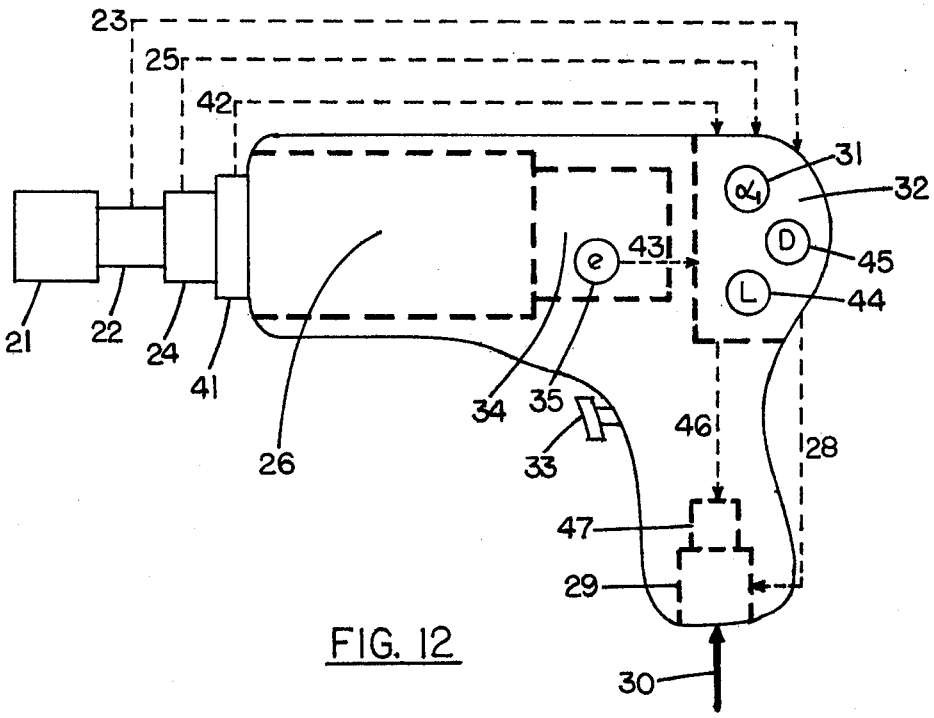
FIG. 12 is a schematic diagram of a prevailing torque type of wrench for tightening bolts which also incorporates impact means for untwisting the bolts according to the teaching of my invention.

When the tightening wrenching means is of the prevailing torque type additional means will have to be provided for producing the impacts for untwisting. This should create no undue complication since impact technology is well developed. Because of recent developments in prevailing torque wrenches it will be possible, if desired, to make the calculation of $N_{Design}$ automatically within the wrench itself. FIG. 12 shows a schematic diagram of a wrench which incorporates this capability. Elements 21 through 31 of FIG. 12 and a modified version of element 32 constitute the components of prevailing torque wrenches now existing (op.-cit., *Design News,* Vol. 30, No. 17, Sept. 8, 1975 page 57) and their incorporation in a wrench such as illustrated in FIG. 12 should be quite straightforward.

The driving socket 21 of FIG. 12 is powered by the prevailing torque wrench motor 26. A torque transducer 22 feeds the current value 233 of the wrenching torque to a computer element 32. The computing element 32 has means 31 for storing in computer memory the angle $\alpha_1$ (see FIG. 1). The nut (or bolt head) rotation angle transducer 24 feeds the current value 25 of the rotation angle to the computer. The computer calculates the slope of the torque-rotation curve of FIG. 1 and when this angle drops to the stored value $\alpha_1$ the computer sends signal 46 to the reversal value (or switch) 47 to shut of the power supply 30 to the prevailing torque motor 26 and supply it to the reverse impact motor 34. The impact motor 34 has means 35 for adjusting the level of the energy e imparted by each reverse impact and means 43 are provided to store the setting of 35 in the memory of the computer 32. Means 44 and 45 are provided for storing in computer memory the values of $L$ and $D$ for the bolt being tightened ($G$ is the same for all steel bolts) and the computer is programmed to calculate $N_{Design}$ from equation (Z). When the torque-rotation curve slope angle reaches $\alpha_1$ and the computer sends signal 46 to stop tightening and begin untwisting, it simultaneously puts the value of $T_{WY}$ in equation (Z) and calculates $N_{Design}$ and stores it in memory. When the impacts begin the impact sensor 41 sends a signal 42 to the computer for each impact and these accumulate in a register. When the number in the register reaches the value $N_{Design}$ stored in the computer memory the computer sends a signal 28 to the valve (or switch) 29 to shut off the power supply 30 to the wrench. Thus, as in the case of the wrench with impact type tightening means, the operator squeezes the trigger 33 and holds it until the wrench stops automatically, at which point the bolt will have been tightened to its yield point and then untwisted to create a built-in overload protection of 10 percent or more without decreasing the tension in the bolt.

I have described these wrenches to illustrate that it will be possible for those skilled in the art of wrenches to develop practical means for carrying out the process of my invention for creating overload protection in a bolt which has been tightened to its yield point, without at the same time reducing the tension in the bolt.

Having described my invention, what I now claim is:

1. A method for creating built-in overload protection against further yielding in a threaded bolt which previously has been tightened to its yield point, said method comprising: reducing the torque acting in the shank of said bolt to fifty percent or less of the valve existing at the end of tightening, said reduction in torque being accomplished by rotating the bolt head or the nut in the direction opposite from tightening through an angle $\theta$ such that the reduction in twist of said shank causes said torque to reduce to fifty percent or less of the value existing at the end of tightening and where said angle of rotation $\theta$ is not large enough to cause decrease in the tension existing in said bolt at the end of tightening.

2. The method of claim 1 wherein said angle of rotation $\theta$ is produced by an impact wrench which delivers to said bolt head or said nut a number of rotational impacts $N$ which depends upon the shank length, diameter and shear modulus of said bolt, upon the wrenching torque acting at the end of tightening and upon the energy transmitted to said bolt head or said nut by each of said impacts.

3. The method of claim 1 wherein said angle of rotation $\theta$ is produced by an impact wrench which delivers to said bolt head or said nut a number of rotational impacts $N$ which depends upon the shank length, diameter and shear modulus of said bolt, upon the wrenching torque acting at the end of tightening and upon the energy transmitted to said bolt head or said nut by each of said impacts, in which said number of rotational impacts $N$ is determined by the formula:

$$N = \frac{4LT_{WY}^2}{\pi G D^4 e}$$

wherein $L$ is said bolt shank length, $D$ is said bolt diameter, $G$ is said bolt shear modulus, $T_{WY}$ is said wrenching torque acting at the end of tightening and $e$ is said energy transmitted by each impact.

4. The method of claim 1 which includes striking the bolt head or the nut with a predetermined number of rotational impacts of equal energy level to cause said rotation to angle $\theta$ of said bolt head or said nut.

5. The method of claim 4 which includes adjusting the energy level of the impacts on the bolt head or the nut.

6. The method of claim 4 which includes counting the number of impacts by detecting electrical signals generated by each impact.

7. The method of claim 6 which includes stopping the impacts when the electrical signals counted reach a predetermined number.

* * * * *